US008746685B1

(12) United States Patent
Fukuzawa et al.

(10) Patent No.: US 8,746,685 B1
(45) Date of Patent: Jun. 10, 2014

(54) IMAGE FORMING APPARATUS

(71) Applicant: Panasonic Corporation, Osaka (JP)

(72) Inventors: Yasufumi Fukuzawa, Fukuoka (JP); Kiyotaka Yamamoto, Fukuoka (JP); Kouji Umeno, Fukuoka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/144,308

(22) Filed: Dec. 30, 2013

(30) Foreign Application Priority Data

Jan. 7, 2013 (JP) ..... 2013-00470

(51) Int. Cl.
*B65H 29/00* (2006.01)

(52) U.S. Cl.
USPC ..... 271/184; 271/185; 271/186; 271/225

(58) Field of Classification Search
USPC ..... 271/225, 902, 184–186
See application file for complete search history.

(56) References Cited

U.S. PATENT DOCUMENTS

| | | | | |
|---|---|---|---|---|
| 7,984,909 | B2 * | 7/2011 | Sunohara | 271/301 |
| 8,538,309 | B2 | 9/2013 | Ban | |
| 2009/0278304 | A1 * | 11/2009 | Hara et al. | 271/225 |
| 2011/0076076 | A1 | 3/2011 | Ban | |

FOREIGN PATENT DOCUMENTS

| | | | |
|---|---|---|---|
| JP | 02-255476 | A | 10/1990 |
| JP | 08-272165 | A | 10/1996 |
| JP | 2006-126251 | A | 5/2006 |
| JP | 2011-090277 | A | 5/2011 |

OTHER PUBLICATIONS

Japanese Office Action, dated May 14, 2013, for corresponding Japanese Application No. JP2013-000470, 2 pages.

* cited by examiner

*Primary Examiner* — Prasad Gokhale
(74) *Attorney, Agent, or Firm* — Seed IP Law Group PLLC

(57) ABSTRACT

Disclosed is a printing apparatus that can prevent the occurrence of a transport error and prevent useless printing even when the sheet size of the actually fed sheet is different from the sheet size specified in the printing setting. The printing apparatus forms an image on one side of a recording medium first and then forms an image on another side of the recording medium. A determination section determines the medium length of the recording medium, and a control section causes the recording medium to be ejected to a sheet ejection port after the image is formed on the one side of the recording medium, when the determined medium length is outside of a preset threshold range.

12 Claims, 5 Drawing Sheets

IMAGE FORMING APPARATUS

TECHNICAL FIELD

The present invention relates to an image forming apparatus including a double-sided printing function.

BACKGROUND ART

In recent years, image forming apparatuses such as a multifunction printer (MFP) including functions of a printer, a copying machine, FAX, and the like have been in widespread use. The image forming apparatuses generally include almost all functions necessary to complete office work, are compact, do not take up too much space, and are also excellent in terms of costs. Thus, the widespread use of these image forming apparatuses is expected to increase.

Additionally, some image forming apparatuses include the double-sided printing function which forms an image on one side of a printing sheet and thereafter forms an image on the reverse side of the printing sheet (for example, refer to Japanese Patent Application Laid-Open No. 2006-126251). In the double-sided printing, an image is also formed on the reverse side by forming an image on one side of the printing sheet in an image forming section and then feeding and reversing the sheet through a double-sided sheet passing path to feed the sheet again into the image forming section.

CITATION LIST

Patent Literature

PTL 1
Japanese Patent Application Laid-Open No. 2006-126251

SUMMARY OF INVENTION

Technical Problem

In the above-described image forming apparatus in which the double-sided printing is possible, if a sheet size (printing setting information) preset before printing and an actually fed sheet size are different from each other, there is a possibility that the following problems occur. For example, when double-sided printing is executed irrespective of whether the actual sheet size is not a size usable for the double-sided printing, a transport error may occur, resulting in the sheet staying on the double-sided sheet passing path and remaining inside the apparatus without being transported. Additionally, if the actual sheet size is the size usable for the double-sided printing but is different from the sheet size specified in the printing setting information, the double-sided printed sheet is not the one requested by the user even when the double-sided printing is executed. Thus, the double-sided printing becomes useless.

An object of the invention is to provide an image forming apparatus that can prevent the occurrence of a transport error and the useless printing even when the sheet size of the actually fed sheet is different from the sheet size specified in the setting of printing.

Solution to Problem

An image forming apparatus according to an aspect of the present invention includes: a printing section that first forms an image on one side of a recording medium and then forms an image on another side of the recording medium; a determination section that determines a medium length of the recording medium; and a control section that causes the recording medium to be ejected to a sheet ejection port after the image is formed on the one side of the recording medium, when the determined medium length is outside of a preset threshold range.

Advantageous Effects of Invention

According to the invention, it is possible to prevent the occurrence of a transport error and a printing error even when the sheet size of the actually fed sheet is different from the sheet size specified in the setting of printing.

DESCRIPTION OF EMBODIMENTS

Hereinafter, an embodiment of the invention will be described in detail with reference to the drawings.

[Overall Configuration of Image Forming System]

Figure 1:
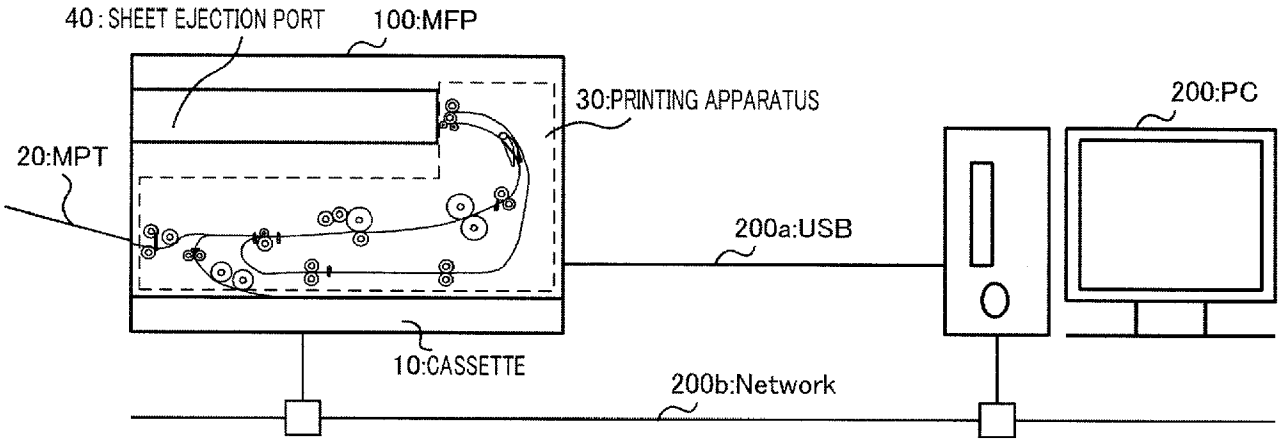
FIG. 1 is an overall configuration diagram of an image forming system in an embodiment of the invention.

FIG. 1 shows an overall configuration diagram of an image forming system including image forming apparatus (MFP) 100 and host computer (PC) 200.

In FIG. 1, USB 200*a* connects image forming apparatus 100 and host computer 200 and transmits data or commands between image forming apparatus 100 and a printer driver of host computer 200. Network 200*b* is, for example, a network such as Ethernet (registered trademark) and can be connected to a telephone line via a modem or can be connected to a WAN.

Image forming apparatus 100 takes out a recording medium (hereinafter referred to as "sheet") housed in cassette (sheet-feeding tray) 10 or multi-purpose tray (MPT) (manual sheet-feeding tray) 20, delivers the recording medium to printing apparatus 30, prints image data on the sheet in printing apparatus 30, and ejects the sheet on which the image data is printed to sheet ejection port 40.

Host computer 200 transmits printing data and commands to image forming apparatus 100 via USB 200*a* or network 200*b*.

[Configuration of Printing Apparatus 30]

Figure 2:
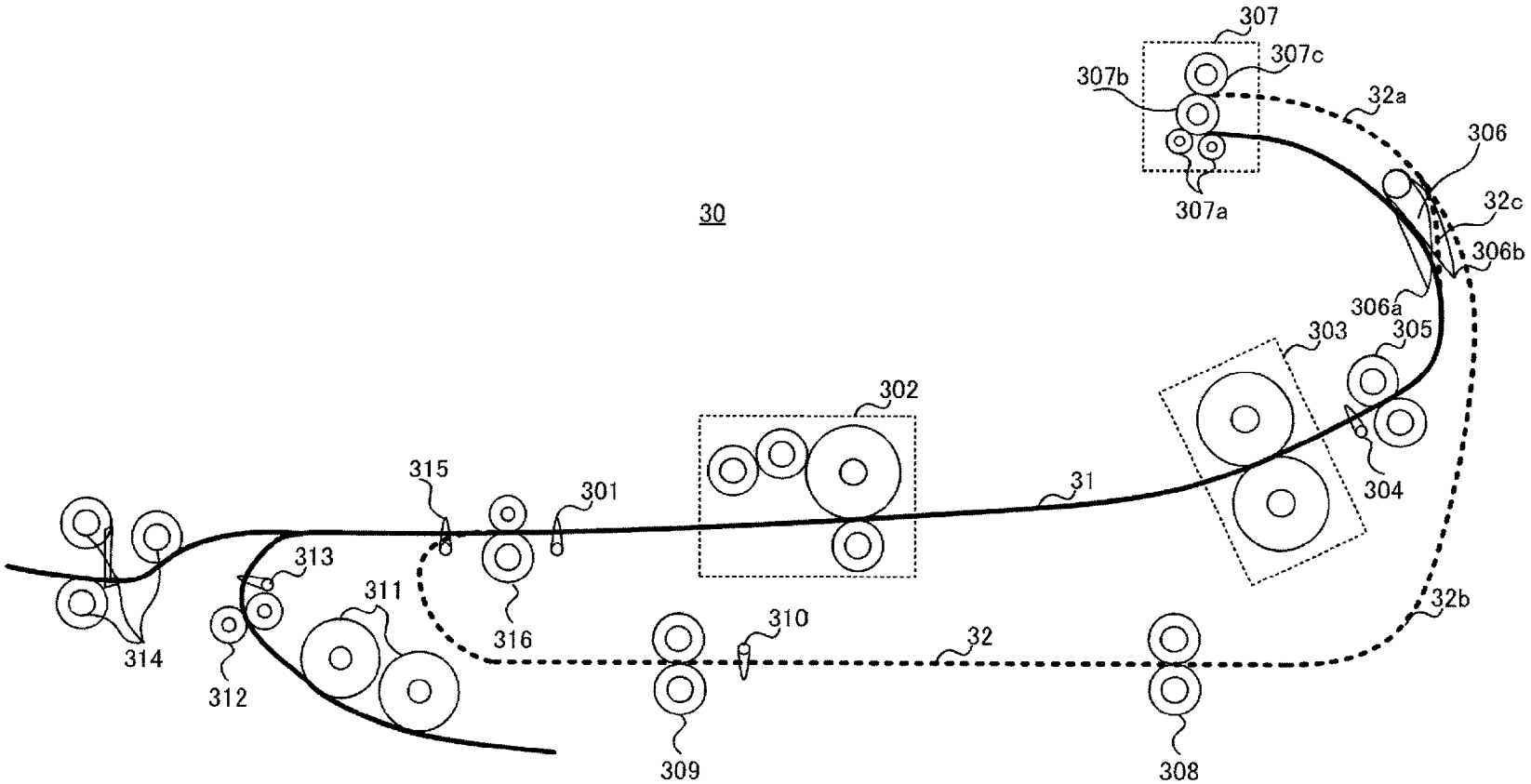
FIG. 2 is a diagram showing the configuration of a printing apparatus in the embodiment of the invention.

FIG. 2 is a diagram showing the configuration of printing apparatus 30. Printing apparatus 30 includes the double-sided printing function of forming an image on one side of a sheet (recording medium) and then forming an image on the other side of the sheet.

Printing apparatus 30 shown in FIG. 2 has single-sided sheet passing path 31 (solid line) and double-sided sheet passing path 32 (broken line) as sheet passing path along which the sheet is transported. Single-sided sheet passing path 31 is a transporting path along which the sheet is transported during single-sided printing or double-sided printing, and is a transporting path along which sheet feeding, image formation, fixation, and sheet ejection are performed.

Double-sided sheet passing path 32 is a sheet passing path along which the sheet is transported during double-sided printing. Double-sided sheet passing path 32 includes sheet passing path 32*a* for reversing (switchback) sheet, sheet passing path 32*b* for allowing the reversed sheet to join single-sided sheet passing path 31 again, and sheet passing path 32*c* for feeding the sheet into sheet passing path 32*b* from single-sided sheet passing path 31.

Top sensor 301 detects whether or not sheet is passing over top sensor 301. Specifically, top sensor 301 generates an OFF signal when no sheet is passing over top sensor 301 and generates an ON signal when a sheet is passing over top sensor 301.

Image forming section 302 transfers a toner image according to image data to the transported sheet, thereby forming an image on the sheet. Fixing section 303 fixes the toner image transferred to the sheet.

Sheet ejection sensor 304 detects whether or not a sheet is passing over sheet ejection sensor 304. Specifically, similar to top sensor 301, sheet ejection sensor 304 generates an OFF signal when no sheet is passing over sheet ejection sensor 304 and generates an ON signal when a sheet is passing over sheet ejection sensor 304.

Sheet ejection roller 305 is placed behind fixing section 303, and transports the transported sheet in the direction of switching lever 306.

Switching lever 306 switches the transportation destination of the sheet transported by sheet ejection roller 305 to any one of single-sided sheet passing path 31 and double-sided sheet passing path 32. In a state where switching lever 306 is at position 306*a*, the sheet is transported in the direction of ejection section 307 on double-sided sheet passing path 32. On the other hand, in a state where switching lever 306 is at position 306*b*, the sheet is transported in the direction of ejection section 307 on single-sided sheet passing path 31.

Ejection section 307 includes rollers 307*a*, 307*b*, and 307*c* placed in proximity to sheet ejection port 40. Roller 307*a* and roller 307*b* constitute an ejection roller that ejects a sheet transported on single-sided sheet passing path 31 to sheet ejection port 40. Additionally, roller 307*b* and roller 307*c* constitute a reversal roller (switchback roller) that reverses the transport direction of the sheet transported on double-sided sheet passing path 32 (sheet passing path 32*a*).

In the following description, the rotation processing of rollers 307*a*, 307*b*, and 307*c* when the sheet transported on single-sided sheet passing path 31 is ejected to sheet ejection port 40 is referred to as "normal rotation processing," and rotation processing reverse to "normal rotation processing" and is referred to as "reverse rotation processing." That is, in the normal rotation processing, a sheet on single-sided sheet passing path 31 is transported by roller 307*a* and roller 307*b* in the direction in which the sheet is ejected to sheet ejection port 40, and a sheet on sheet passing path 32*a* is transported by roller 307*b* and roller 307*c* in the direction of sheet passing path 32*b*. On the other hand, in the reverse rotation processing, sheet on sheet passing path 32*a* is transported by roller 307*b* and roller 307*c* in the direction in which the sheet is ejected to sheet ejection port 40.

That is, during the double-sided printing, ejection section 307 pulls the sheet transported on sheet passing path 32*c* to sheet passing path 32*a* by the reverse rotation processing of the reversal roller (rollers 307*b* and 307*c*). Next, ejection section 307 transports the sheet on sheet passing path 32*a* in the direction of sheet passing path 32*b* by the normal rotation processing of the reversal roller.

Rollers 308 and 309 transport the sheet transported from ejection section 307 to sheet passing path 32*b*, in the direction of single-sided sheet passing path 31. Since the two sides of the sheet that has joined single-sided sheet passing path 31 from sheet passing path 32*b* have been reversed, the double-sided printing is enabled in printing apparatus 30. Automatic duplex unit (ADU) sensor 310 detects whether or not a sheet has passed over ADU sensor 310, thereby detecting that the sheet is being transported along sheet passing path 32*b*.

Roller 311 takes out sheets one by one from cassette 10, and roller 312 delivers taken-out sheet to single-sided sheet passing path 31. Pickup sensor 313 detects whether or not the sheet has passed over pickup sensor 313, thereby detecting that the sheet is taken out from cassette 10.

Roller 314 takes out sheets one by one from MPT 20, and delivers the taken-out sheet to single-sided sheet passing path 31.

Registration sensor 315 detects whether or not a sheet has passed over registration sensor 315. Registration roller 316 corrects the leading end position of the sheet to be transported, on the basis of a position detected by registration sensor 315. This allows an image to be printed and fed sheet to be synchronized with each other.

[Configuration of Image Forming Apparatus 100]

Figure 3:
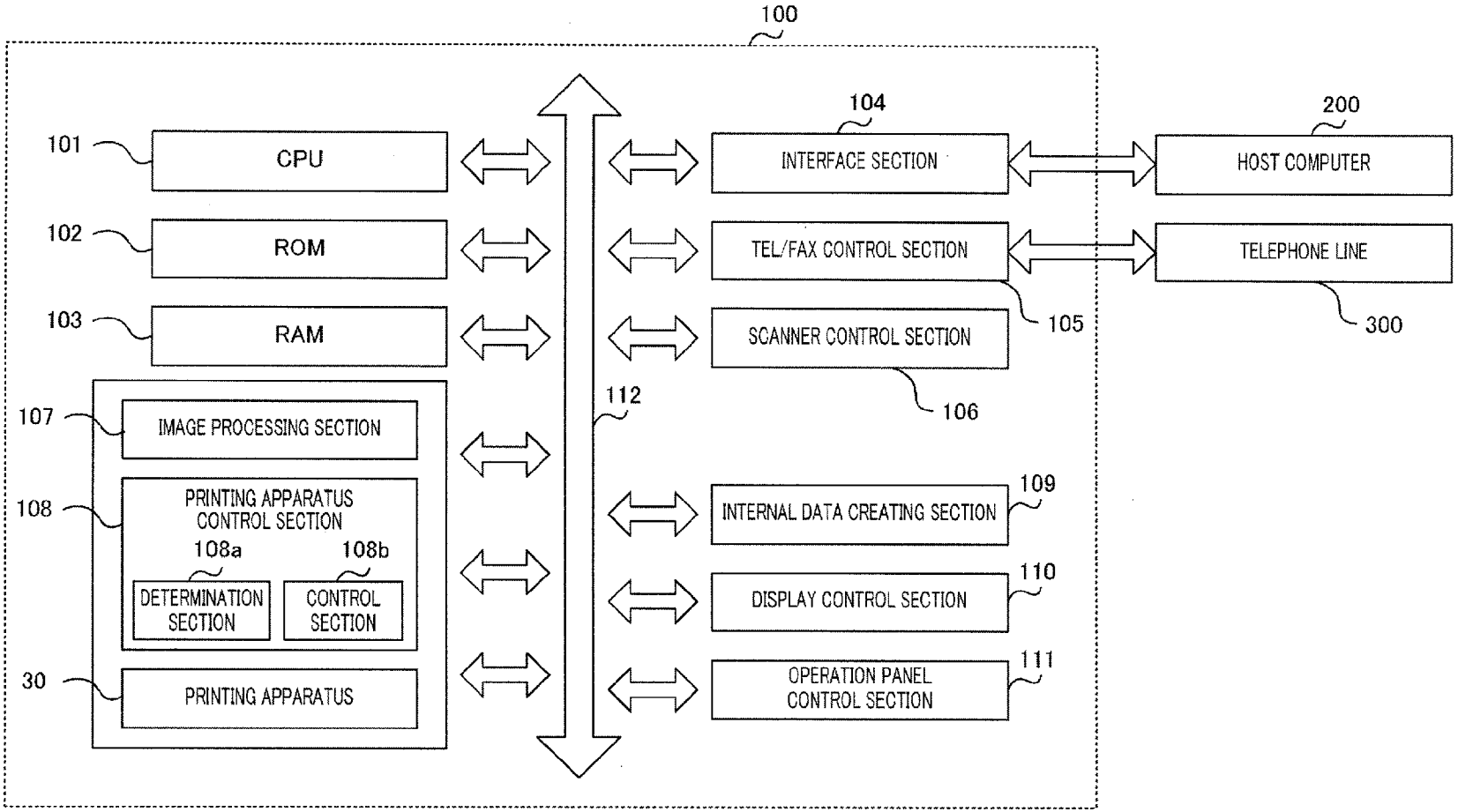
FIG. 3 is a block diagram showing a control configuration of an image forming apparatus in the embodiment of the invention.

FIG. 3 is a block diagram showing a control configuration of image forming apparatus 100. The configuration sections shown in FIG. 3 transmit and receive data through internal bus 112.

In FIG. 3, central processing unit (CPU) 101 reads a program from read-only memory (ROM) 102 or random access memory (RAM) 103 and executes various functions to be achieved by the program.

In addition, as ROM 102, for example, a flash ROM, an electrically erasable programmable ROM (EEPROM), or other nonvolatile memories may be provided. Additionally, information used for printing processing, such as printing data, printing setting information (printing sheet size or the like), and signals detected by individual sensors (top sensor 301, sheet ejection sensor 304, and the like), is temporarily stored in RAM 103.

Interface section 104 performs communication between image forming apparatus 100 and host computer 200. For example, interface section 104 is a USB interface. TEL/FAX control section 105 is connected to a telephone line or WAN (not shown) to perform communication. Scanner control section 106 reads an image through a charge coupled device (CCD) or a contact image sensor (CIS).

Image processing section 107 performs image processing, such as data analysis processing, rotation processing, and reduction processing, on image data received from interface section 104, TEL/FAX control section 105, or scanner control section 106. Printing apparatus control section 108 controls printing (output processing or the like) of the image data processed by image processing section 107 and controls printing apparatus 30. Printing apparatus 30 transfers image data to a recording sheet according to instructions of printing apparatus control section 108, and fixes and prints the image data.

Internal data creating section 109 stores a test printing pattern, help printing, or an incoming call history, and creates printing data (internal data) on the basis of the stored information. Display control section 110 controls a display apparatus (not shown) such as a liquid crystal panel. Operation panel control section 111 controls various settings through input operation to the operation panel.

FIG. 3 shows determination section 108*a* and control section 108*b* that are features of the present embodiment in printing apparatus control section 108.

Determination section 108*a* performs sheet length determination processing in which the sheet length (sheet size) is determined. For example, determination section 108*a* detects a timing at which a sheet begins passing over top sensor 301 (timing at which switching is made from an OFF signal to an ON signal), and a timing (timing at which switching is made from an ON signal to an OFF signal) at which the sheet finishes passing over top sensor 301, on the basis of the ON signal/OFF signal received from top sensor 301. Also, determination section 108*a* determines the sheet length (length between the leading end and back end of sheet), using the timing at which the sheet begins passing over top sensor 301 and the timing at which the sheet finishes passing over top sensor.

Control section 108*b* controls the printing processing including ejection processing of a sheet. Specifically, control section 108*b* compares the sheet length determined in determination section 108*a* with a sheet size (preset sheet length) shown in the printing setting information stored in RAM 103, in the ejection processing.

Specifically, control section 108*b* determines whether the determined sheet length is within a preset threshold range or is outside of the threshold range. Here, the above threshold range is set corresponding to each of sheet sizes (sheet lengths) shown in the printing setting information. Control section 108*b* determines that the determined sheet length is the same as a sheet size shown in the printing setting information when the determined sheet length is within the threshold range, and determines that the determined sheet length is different from the sheet size shown in the printing setting information when the determined sheet length is outside of the threshold range. Setting the threshold range in this manner takes care of a determination error of the sheet length by top sensor 301.

Also, control section 108*b* ejects a sheet to sheet ejection port 40 after one side of the sheet is printed when the sheet length determined in determination section 108*a* and the preset sheet length are different from each other as a result of the comparison of sheet size (when the sheet length is outside of the threshold range). On the other hand, control section 108*b* subsequently instructs the printing apparatus to perform the printing of the other side of sheet after one side of the sheet is printed when the sheet length determined in determination section 108*a* and the preset sheet length are same as a result of the comparison of sheet size (when the sheet length is within the threshold range). That is, control section 108*b* instructs printing apparatus 30 to perform printing/ejection processing on the basis of the determination result. In addition, the details of the ejection processing in the control section 108*b* will be described below.

[Output of Image Forming Apparatus]

Figure 4:
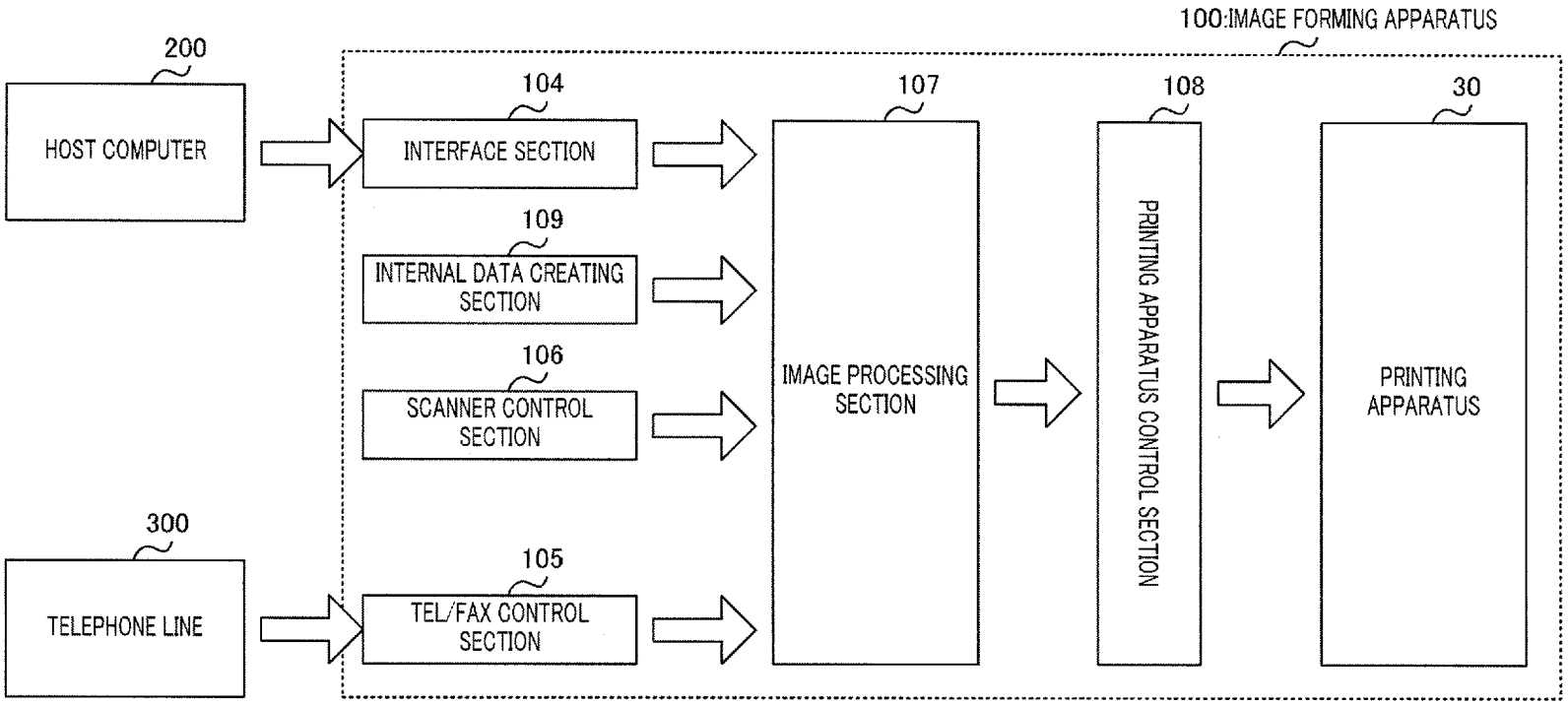
FIG. 4 is an explanatory view of the output of the image forming apparatus in the embodiment of the invention.

FIG. 4 is an explanatory view of the output of image forming apparatus 100.

As shown in FIG. 4, first, image forming apparatus 100 loads image data. Specifically, upon reception of a printing command from host computer 200, image data (printing data) is sent to printing apparatus 30 via interface section 104. Additionally, upon reception of a printing command via telephone line 300 or a WAN, image data is sent to printing apparatus 30 via TEL/FAX control section 105. Additionally in scanner control section 106, the image signals of an original are read, and data obtained by converting amplified image signals into digital signals are sent to printing apparatus 30 as image data. Additionally in internal data creating section 109, created internal data is sent to printing apparatus 30.

Additionally, the printing data sent to printing apparatus 30 is subjected to data analysis, rotation processing, reduction processing, or the like in image processing section 107 if necessary, and desired output processing (for example, page layout or the like) is performed in printing apparatus control section 108, and the processed printing data is output to printing apparatus 30.

[Operation of Image Forming Apparatus]

Figure 5:
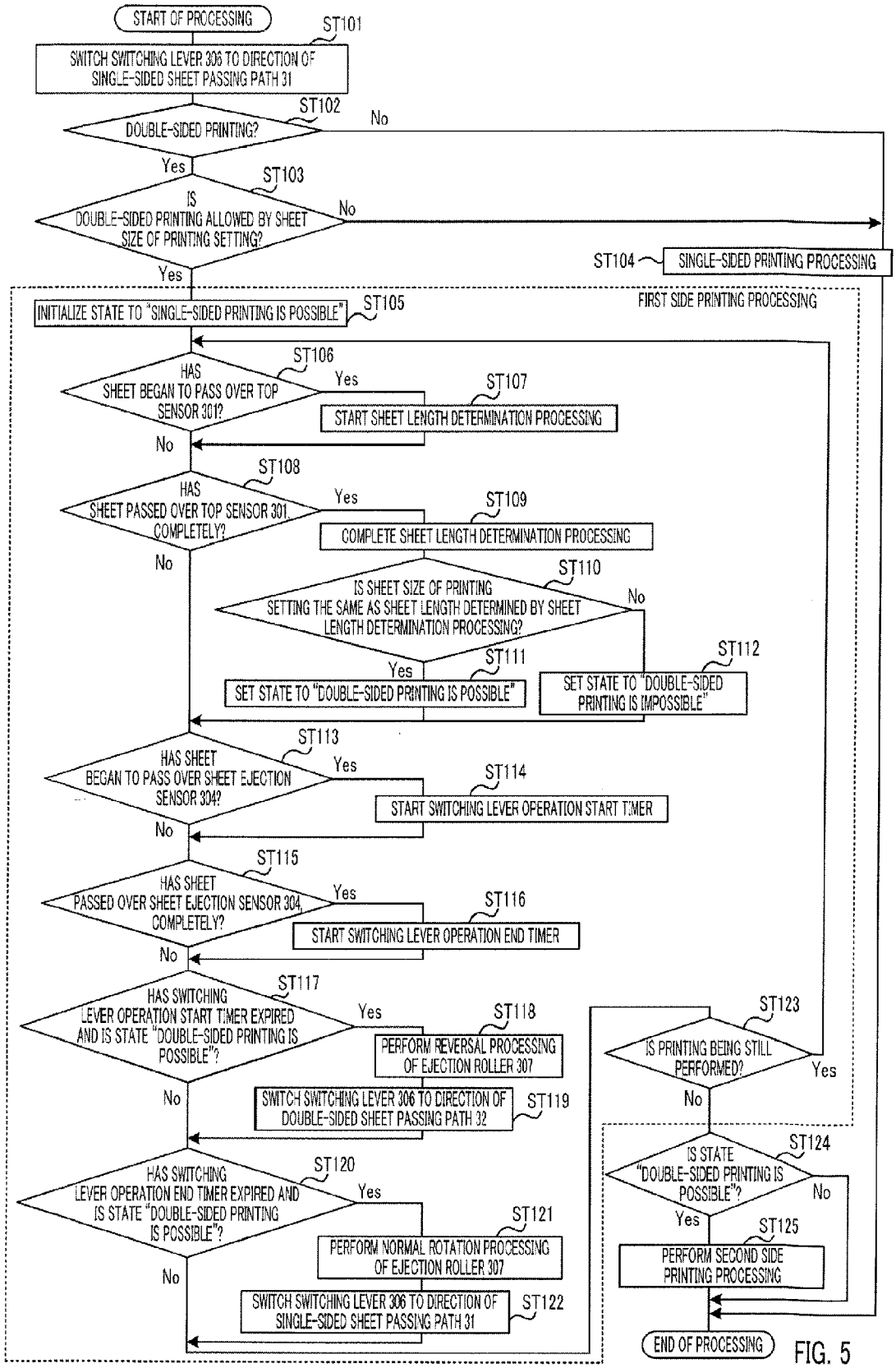
FIG. 5 is a flowchart showing the flow of processing of the image forming apparatus in the embodiment of the invention.

FIG. 5 is a flowchart showing the flow of printing processing in image forming apparatus 100.

In the following description, rear surface printing during the double-sided printing is referred to as "first side printing processing," and front surface printing is referred to as "second side printing processing." Additionally, processing from steps (hereinafter referred to as "ST") 105 to 123 is equivalent to the first side printing processing.

In ST101, switching lever 306 is switched to the direction of single-sided sheet passing path 31. That is, switching lever 306 is brought into the state of position 306*b* (FIG. 2).

In ST102, control section 108*b* determines whether or not printing setting is at the double-sided printing on the basis of the printing setting information. Control section 108*b* proceeds to processing of ST103 when the printing setting is at the double-sided printing (ST102: Yes), and proceeds to processing of ST104 when the printing setting is not at the double-sided printing (ST102: No).

In ST103, control section 108*b* determines whether or not the sheet size specified in the printing setting is a size allowing the double-sided printing, on the basis of the printing setting information. Control section 108*b* proceeds to processing of ST104 when the double-sided printing is not possible (ST103: No) and proceeds to processing of ST105 when the double-sided printing is possible (ST103: Yes). For example, the path between sheet ejection roller 305 and roller 307*c* or the sheet size of a sheet capable of being transported along the path between roller 307*c* and roller 308 may be defined as "sheet size that allows the double-sided printing," and a sheet size other than the sheet size that allows the double-sided printing may be distinguished as "sheet size such that does not allow the double-sided printing."

When the printing setting is the single-sided printing (ST102: No), or when the sheet size specified in the printing setting is a size allowing the double-sided printing (ST103: No), printing apparatus 30 performs single-sided printing in ST104.

In ST105, control section 108*b* initializes a "state" showing whether or not the double-sided printing is possible to "double-sided printing is possible."

In ST106, control section 108*b* determines whether or not the sheet has begun to pass over top sensor 301, on the basis of a signal detected by top sensor 301. Control section 108*b* proceeds to processing of ST108 at the timing other than the timing at which the sheet has begun to pass over top sensor 301 (ST106: No). On the other hand, determination section 108*a* starts sheet length determination processing in ST107, at the timing the sheet has begun to pass over top sensor 301 (ST106: Yes).

In ST108, control section 108*b* determines whether or not the sheet has finished passing over top sensor 301, on the basis of the signal detected by top sensor 301. Control section 108*b* proceeds to processing of ST113 at the timing other than the timing at which the sheet has finished passing over top sensor 301(ST108: No). On the other hand, determination section 108*a* completes, in ST109, the sheet length determination processing started in ST107, at the timing the sheet has finished passing over top sensor 301 (ST108: Yes). That is, determination section 108*a* determines the sheet length, using the timing at which the sheet has begun to pass over top sensor 301 and the timing at which the sheet has finished passing over top sensor 301.

In ST110, control section 108*b* determines whether or not the sheet size (preset sheet length) specified in the printing setting is the same as the sheet length determined in ST109. When the sheet size specified in the printing setting and the determined sheet length are the same (ST110: Yes), control section 108*b* set the "state" showing whether or not the double-sided printing is possible to "double-sided printing is possible" in ST111. On the other hand, when the sheet size in printing setting and the determined sheet length are different from each other (ST110: No), control section 108*b* sets the "state" showing whether or not the double-sided printing is possible to "double-sided printing is impossible" in ST112.

In ST113, control section 108*b* determines whether or not the sheet has begun to pass over sheet ejection sensor 304, on the basis of a signal detected by sheet ejection sensor 304. Control section proceeds to processing of ST115 at the timing other than the timing at which the sheet has begun to pass over sheet ejection sensor 304 (ST113: No). On the other hand, control section 108*b* starts a "switching lever operation start timer" for controlling the start of operation of switching lever 306 in ST114, at the timing the sheet has begun to pass over sheet ejection sensor 304 (ST113: Yes). The period until the leading end of the sheet reaches a position right before switching lever 306 after passed over sheet ejection sensor 304 is clocked by the switching lever operation start timer. That is, the switching operation of switching lever 306 is possible until the switching lever operation start timer expires.

In ST115, control section 108*b* determines whether or not the sheet has finished passing over sheet ejection sensor 304, on the basis of the signal detected by sheet ejection sensor 304. Control section 108*b* proceeds to processing of ST117 at the timing other than the timing at which the sheet has finished passing over sheet ejection sensor 304 (ST115: No). On the other hand, control section 108*b* starts a "switching lever operation end timer" for controlling the end of operation of switching lever 306 in ST116 at the timing the sheet has finished passing over sheet ejection sensor 304 (ST115: Yes). The time until the back end of the sheet reaches the top of switching lever 306 after passed over sheet ejection sensor 304 is clocked by the switching lever operation end timer.

In ST117, control section 108*b* determines whether or not the switching lever operation start timer started in ST114 expires and the "state" showing whether or not the double-sided printing is possible is "double-sided printing is possible."

When the switching lever operation start timer does not expire or when the "state" is not "double-sided printing is possible" (ST117: No), control section 108*b* proceeds to processing of ST120. On the other hand, when the switching lever operation start timer expires and when the "state" is "double-sided printing is possible" (ST117: Yes), control section 108*b* makes ejection section 307 perform the reverse rotation processing in ST118, and switches switching lever 306 in the direction of double-sided sheet passing path 32 (state of position 306*a*) in ST119. This allows sheet transported from sheet ejection roller 305 to be transported in the direction of ejection section 307 on sheet passing path 32*a* by reverse rotation processing of rollers 307*b* and 307*c*.

In ST120, control section 108*b* determines whether or not the switching lever operation end timer started in ST116 expires and the "state" showing whether or not the double-sided printing is possible is "double-sided printing is possible."

When the switching lever operation end timer does not expire or when the "state" is not "double-sided printing is possible" (ST120: No), control section 108*b* proceeds to processing of ST123. On the other hand, when the switching lever operation end timer expires and when the "state" is "double-sided printing is possible" (ST120: Yes), control section 108*b* makes ejection section 307 perform the normal rotation processing in ST121, and switches switching lever 306 in the direction of single-sided sheet passing path 31 (state of position 306*b*) in ST122. This allows the sheet whose back end is also transported to the top of the sheet passing path 32*a* to be transported in the direction of sheet passing path 32*b* by the normal rotation processing of rollers 307*b* and 307*c*.

In ST123, control section 108*b* determines whether or not the first side printing is in process. Control section 108*b* returns to the processing of ST106 when the first side printing is in process (ST123: Yes), and proceeds to processing of ST124 when the first side printing is completed (ST123: No).

In ST124, control section 108*b* determines whether or not the "state" showing whether or not the double-sided printing is possible is "double-sided printing is possible." When the "state" is "double-sided printing is possible" (ST124: Yes), printing apparatus 30 performs the second side printing in ST125. When the "state" is not "double-sided printing is possible" (ST124: No), the second side printing is not performed and the printing is completed in printing apparatus 30.

[Ejection Processing in Image Forming Apparatus 100]

Next, the operation of image forming apparatus 100 when the sheet size specified in the printing setting and the actually fed sheet length are different from each other in a case where the setting of the double-sided printing is made (ST102: Yes) and the sheet size specified in the printing setting is the sheet size that allows the double-sided printing (ST103: Yes) will be described.

[Ejection Processing when Sheet Length is Short]

First, the ejection processing when the sheet length of a fed sheet is shorter than the sheet size specified in the printing setting will be described.

In addition, the term "sheet length is short" is at least a sheet of such a size that the back end of the sheet finishes passing over top sensor 301 until the leading end of the sheet reaches a position right before switching lever 306 (that is, until the switching lever operation start timer expires).

First, if the sheet begins passing over top sensor 301 (ST106: Yes), determination section 108*a* starts the sheet length determination processing (ST107).

As described above, when the sheet size is short, the sheet finishes passing over top sensor 301 before the switching lever operation start timer expires. Additionally, as shown in FIG. 5, it is obvious that the sheet does not finish passing over sheet ejection sensor 304 (the switching lever operation end timer is not started) until the sheet finishes passing over top sensor 301. Hence, repetition processing (ST123: Yes) of ST123 is performed until the sheet finishes passing over top sensor 301.

When the sheet finishes passing over top sensor 301 (ST108: Yes), determination section 108*a* completes the sheet length determination processing (ST109). At this time, control section 108*b* determines that the sheet length (determined sheet length) of the fed sheet is shorter than the sheet size specified in the printing setting (ST110: No). That is, control section 108*b* determines that the determined sheet length is shorter than a lower limit threshold of a threshold range corresponding to the sheet size specified in the printing setting. Thus, control section 108*b* sets the "state" showing whether or not the double-sided printing is possible to "double-sided printing is impossible" (ST112).

Since the "state" is not "double-sided printing is possible" (ST117: No and ST120: No), the processing of ST118, ST119, ST121, and ST122 are not performed and the repetition processing (ST123: Yes) of ST123 is performed, until the first side printing is completed (ST123: No).

Upon completion of the first side printing (ST123: No), since the "state" showing whether or not the double-sided printing is possible is "double-sided printing is impossible" (ST124: No), the second side printing is not performed, and the printing is completed.

Here, switching lever 306 remains switched in the direction of single-sided sheet passing path 31 (ST101). Hence, the sheet is transported on single-sided sheet passing path 31 and ejected from ejection section 307 (ejection roller) to sheet ejection port 40.

When the sheet length of the fed sheet is shorter than the sheet length specified in the printing setting in this way (when shorter than the lower limit threshold of the threshold range), control section 108*b* causes the sheet to be ejected from single-sided sheet passing path 31 to sheet ejection port 40 without performing the second side printing after the first side printing is completed.

Here, in the configuration of printing apparatus 30 shown in FIG. 2, it is assumed that the length of a sheet passing path (here, referred to as a first sheet passing path) along which a sheet is transported from sheet ejection roller 305 to the ejection roller (rollers 307*a* and 307*b*) is shorter than the length of a sheet passing path (here, referred to as a second sheet passing path) along which a sheet is transported from sheet ejection roller 305 to the reversal roller (307*c*, 307*b*). Additionally, it is assumed the length of a sheet passing path (here, referred to as a third sheet passing path) along which a sheet is transported from the reversal roller (rollers 307*c* and 307*b*) to roller 308 is further longer than the length of the second sheet passing path. Hence, when a sheet with a short sheet size (sheet length) is transported along double-sided sheet passing path 32, a possibility that the sheet remains within printing apparatus 30 (the second sheet passing path or the third sheet passing path) is high.

In contrast, in the present embodiment, a sheet with a short sheet size is transported on single-sided sheet passing path 31 (the first sheet passing path) and is forcibly ejected to sheet ejection port 40, the sheet does not remain within printing apparatus 30 and no transport error occurs.

[Ejection Processing when Sheet Length is Long]

Next, the ejection processing when the sheet length of a fed sheet is longer than the sheet size specified in the printing setting will be described.

In addition, a sheet referred to as the term "sheet length is long" is a sheet that is longer than the length between top sensor 301 and a position (the position of the leading end of the sheet when the switching lever operation start timer expires) right before switching lever 306. In other words, the sheet finishes passing over top sensor 301 after the switching lever operation start timer expires.

First, if the sheet begins passing over top sensor 301 (ST106: Yes), determination section 108*a* starts the sheet length determination processing (ST107). The repetition processing (ST123: Yes) of ST123 is performed until the sheet begins passing over sheet ejection sensor 304.

Next, if the leading end of the sheet begins passing over sheet ejection sensor 304 (ST113: Yes), control section 108*b* starts the switching lever operation start timer. The repetition processing (ST123: Yes) of ST123 is performed until the switching lever operation start timer expires.

If the switching lever operation start timer expires (ST117: Yes), control section 108*b* makes ejection section 307 perform the reverse rotation processing (ST118) and switches switching lever 306 in the direction of double-sided sheet passing path 32 (ST119). That is, printing apparatus 30 transports the sheet transported on double-sided sheet passing path 32 (sheet passing path 32*c*) in the direction of sheet ejection port 40. This serves as an operation in which printing apparatus 30 ejects the sheet from double-sided sheet passing path 32 to sheet ejection port 40.

As described above, it is obvious that the sheet does not passes over sheet ejection sensor 304 (the switching lever operation end timer is not started), completely until the sheet passes over top sensor 301, completely. Hence, the repetition processing (ST123: Yes) of ST123 is performed until the sheet passes over top sensor 301, completely.

When the sheet completely passes over top sensor 301 (ST108: Yes), completely, determination section 108*a* completes the sheet length determination processing (ST109). At this time, control section 108*b* determines that the sheet length (determined sheet length) of the fed sheet is longer than the sheet size specified in the printing setting (ST110: No). That is, control section 108*b* determines that the determined sheet length is longer than an upper limit threshold of the threshold range corresponding to the sheet size specified in the printing setting. Thus, control section 108*b* sets the "state" showing whether or not the double-sided printing is possible to "double-sided printing is impossible" (ST112).

Since the "state" is not "double-sided printing is possible" (ST117: No and ST120: No), the repetition processing (ST123: Yes) of ST123 is performed until the first side printing is completed (ST123: No).

When the first side printing is completed (ST123: No), the "state" showing whether or not the double-sided printing is possible is "double-sided printing is impossible" (ST124: No). Accordingly, the printing is completed without the second side printing being performed.

In this way, the sheet length determination processing is certainly completed before the switching lever operation end timer expires. Hence, the normal rotation processing (ST121) is not performed in ejection section 307 before the sheet length determination processing is completed. That is, in printing apparatus 30, the processing (ejection processing of sheet from double-sided sheet passing path 32) of ST118 and ST119 executed when the switching lever operation start timer expires (ST117: YES) is continued. Therefore, the sheet is transported on double-sided sheet passing path 32 (sheet passing path 32*a*) and ejected from ejection section 307 (reversal roller) to sheet ejection port 40.

When the sheet size of the fed sheet is longer than the sheet size specified in the printing setting in this way (when longer than the upper limit threshold of the threshold range), control section 108*b* causes the sheet to be ejected from double-sided sheet passing path 32 to sheet ejection port without performing the second side printing after the first side printing is completed.

In this way, a sheet with a long sheet size is transported on double-sided sheet passing path 32 after the first side printing and forcibly ejected to sheet ejection port 40. Accordingly, no useless printing (the second side printing processing) in printing apparatus 30 is performed.

As described above, image forming apparatus 100 forcibly ejects the sheet to sheet ejection port 40 after one side of the sheet is printed when the sheet length (determined sheet length) of the actually fed sheet is different from the sheet length (preset sheet length) specified in the printing setting. As a result, according to the present embodiment, it is possible to prevent the occurrence of a transport error and useless printing even when the actual sheet size is different from the sheet size specified in the printing setting.

For example, preventing the occurrence (sheet remaining within the apparatus) of a transport error makes it possible to eliminate the need for the user to open a cover of image forming apparatus 100 and to remove the sheet remaining within the apparatus. Additionally, image forming apparatus 100 feeds the proper sheet to printing apparatus 30 again after the jammed sheet is forcibly ejected to the sheet ejection port. Thus, high-speed printing is made possible because manual ejection of sheet is no longer necessary, for example.

Additionally, preventing the occurrence of useless printing processing allow the next printing to be started immediately as compared to a case where the sheet is ejected after completion of the double-sided printing processing. Thus, high-speed printing is made possible in image forming apparatus 100 because the second side printing is no longer necessary.

In addition, although a case where a sheet is used as a recording medium is described in the above embodiments, the recording medium is not limited to any sheet, and any recording medium can be used as long as the double-sided printing is possible.

The disclosure of Japanese Patent Application No. 2013-000470, filed on Jan. 7, 2013, including the specification, drawings and abstract is incorporated herein by reference in its entirety.

REFERENCE SIGNS LIST

100 Image forming apparatus
10 Cassette
20 MPT
30 Printing apparatus
40 Sheet ejection port
101 CPU
102 ROM
103 RAM
104 Interface section
105 TEL/FAX control section
106 Scanner control section
107 Image processing section
108 Printing apparatus control section
108*a* Determination section
108*b* Control section
109 Internal data creating section
110 Display control section
111 Operation panel control section
31 Single-sided sheet passing path
32 Double-sided sheet passing path
32*a* sheet passing path
32*b* sheet passing path
32*c* sheet passing path
301 Top sensor
302 Image forming section
303 Fixing Section
304 Sheet ejection sensor
305 Sheet ejection roller
306 Switching lever
307 Ejection section
307*a*, 307*b*, 307*c*, 308, 309, 311, 312, 314 Roller
310 ADU sensor
313 Pickup sensor
315 Registration sensor
316 Registration roller

The invention claimed is:

1. An image forming apparatus comprising:

a printing section that first forms an image on one side of a recording medium and then forms an image on another side of the recording medium;

a determination section that determines a medium length of the recording medium; and a control section that causes the recording medium to be ejected to a sheet ejection port after the image is formed on the one side of the recording medium, when the determined medium length is outside of a preset threshold range, wherein:

the printing section includes: a first sheet passing path along which the recording medium is transported from a sheet ejection roller placed behind a fixing section to an ejection roller placed in proximity to the sheet ejection port; and a second sheet passing path along which the recording medium is transported from the sheet ejection roller to a reversal roller placed in proximity to the sheet ejection port;

the first sheet passing path includes a length shorter than a length of the second sheet passing path; and the control section transports the recording medium including the image formed on the one side of the recording medium to the second sheet passing path and returns the recording medium to the printing section by reversing the transport direction of the recording medium by the reversal roller, when the determined medium length is within the threshold range, and the control section causes the recording medium including the image formed on the one side of the recording medium to be ejected from the first sheet passing path to the sheet ejection port, when the determined medium length is shorter than a lower limit threshold of the threshold range.

2. The image forming apparatus according to claim 1, wherein the control section causes the recording medium including the image formed on the one side of the recording medium to be ejected from the second sheet passing path to the sheet ejection port, when the determined medium length is longer than an upper limit threshold of the threshold range.

3. The image forming apparatus according to claim 1, wherein the ejection roller and the reversal roller include three rollers.

4. The image forming apparatus according to claim 1, wherein the reversal roller is placed at a position higher than the ejection roller.

5. An image forming apparatus comprising:

a printing section that first forms an image on one side of a recording medium and then forms an image on another side of the recording medium;

a determination section that determines a medium length of the recording medium using a timing at which the recording medium begins passing over a sensor and a timing at which the recording medium finishes passing over the sensor; and a control section that causes the recording medium to be ejected to a sheet ejection port after the image is formed on the one side of the recording medium, when the determined medium length is outside of a preset threshold range, wherein:

the printing section includes: a first sheet passing path along which the recording medium is transported from a sheet ejection roller placed behind a fixing section to an ejection roller placed in proximity to the sheet ejection port; and a second sheet passing path along which the recording medium is transported from the sheet ejection roller to a reversal roller placed in proximity to the sheet ejection port;

the first sheet passing path includes a length shorter than a length of the second sheet passing path; and the control section transports the recording medium including the image formed on the one side of the recording medium to the second sheet passing path and returns the recording medium to the printing section by reversing the transport direction of the recording medium by the reversal roller, when the determined medium length is within the threshold range, and the control section causes the recording medium including the image formed on the one side of the recording medium to be ejected from the first sheet passing path to the sheet ejection port, when the determined medium length is shorter than a lower limit threshold of the threshold range.

6. The image forming apparatus according to claim 5, wherein the control section causes the recording medium including the image formed on the one side of the recording medium to be ejected from the second sheet passing path to the sheet ejection port, when the determined medium length is longer than an upper limit threshold of the threshold range.

7. The image forming apparatus according to claim 5, wherein the ejection roller and the reversal roller include three rollers.

8. The image forming apparatus according to claim 5, wherein the reversal roller is placed at a position higher than the ejection roller.

9. An image forming apparatus comprising:

a printing section that first forms an image on one side of a recording medium and then forms an image on another side of the recording medium;

a determination section that determines a medium length of the recording medium using a timing at which the recording medium begins passing over a sensor and a timing at which the recording medium finishes passing over the sensor; and a control section that causes the recording medium to be ejected to a sheet ejection port after the image is formed on the one side of the recording medium, when the determined medium length is outside of a threshold range which is preset in accordance with a recording medium size indicated by printing setting information, wherein:

the printing section includes: a first sheet passing path along which the recording medium is transported from a sheet ejection roller placed behind a fixing section to an ejection roller placed in proximity to the sheet ejection port; and a second sheet passing path along which the recording medium is transported from the sheet ejection roller to a reversal roller placed in proximity to the sheet ejection port;

the first sheet passing path includes a length shorter than a length of the second sheet passing path; and the control section transports the recording medium including the image formed on the one side of the recording medium to the second sheet passing path and returns the recording medium to the printing section by reversing the transport direction of the recording medium by the reversal roller, when the determined medium length is within the threshold range, and the control section causes the recording medium including the image formed on the one side of the recording medium to be ejected from the first sheet passing path to the sheet ejection port, when the determined medium length is shorter than a lower limit threshold of the threshold range.

10. The image forming apparatus according to claim 9, wherein the control section causes the recording medium including the image formed on the one side of the recording medium to be ejected from the second sheet passing path to the sheet ejection port, when the determined medium length is longer than an upper limit threshold of the threshold range.

11. The image forming apparatus according to claim 9, wherein the ejection roller and the reversal roller include three rollers.

12. The image forming apparatus according to claim 9, wherein the reversal roller is placed at a position higher than the ejection roller.

* * * * *